United States Patent [19]

Maruyama et al.

[11] Patent Number: 5,006,767

[45] Date of Patent: Apr. 9, 1991

[54] ELECTRIC CONTROL APPARATUS FOR DISHWASHING MACHINE

[75] Inventors: Fumio Maruyama, Nagoya; Tomio Suyama; Hiroaki Kamino, both of Toyoake; Koji Suyama, Shimane; Tokihiro Kuwahara, Kariya; Osamu Nagata, Toyoake, all of Japan

[73] Assignee: Hoshizaki Denki Kabushiki Kaisha, Toyoake, Japan

[21] Appl. No.: 487,327

[22] Filed: Mar. 2, 1990

[30] Foreign Application Priority Data

Mar. 3, 1989 [JP] Japan ..... 1-52475
Aug. 28, 1989 [JP] Japan ..... 1-221120

[51] Int. Cl.[5] ..... B08B 3/02

[52] U.S. Cl. ..... 318/103; 134/57 D; 134/58 D

[58] Field of Search ..... 318/567, 49, 51, 53, 318/101, 102, 103; 68/12 R; 134/18, 25.1, 25.2, 56 R, 56 D, 57 R, 57 D, 58 R, 58 D

[56] References Cited

U.S. PATENT DOCUMENTS 4,001,599 1/1977 Karklys ..... 134/58 D X
4,114,190 9/1978 Mazuir ..... 134/57 D X
4,241,400 12/1980 Kiefer ..... 134/57 D X
4,468,333 8/1984 Geiger ..... 134/25.2 X

*Primary Examiner*—Bentsu Ro
*Attorney, Agent, or Firm*—Armstrong, Nikaido, Marmelstein, Kubovcik & Murray

[57] ABSTRACT

In a dishwashing machine having a washing chamber, an electrically operated wash pump for pumping out wash water from a wash tank in the washing chamber, an electrically operated rinse pump for pumping out heated water from a gas booster heater, and wash and rinse arms arranged within the washing chamber to be supplied with the wash and heated water from the wash and rinse pumps for directing jet streams of the wash and heated water to tableware racked in the washing chamber respectively, an electric control apparatus is arranged to mix cold water from a source of cold water into the heated water to form mixing water and to control the rinse pump such that the rinse arm directs jet stream of the mixing water to the racked tableware. The electric control apparatus is further arranged to control the wash pump in response to finish in control of the rinse pump such that the wash arm directs jet stream of the wash water to the racked tableware and to again control the rinse pump in response to finish in control of the wash pump such that the rinse arm directs jet stream of the heated water to the racked tableware.

12 Claims, 11 Drawing Sheets

ELECTRIC CONTROL APPARATUS FOR DISHWASHING MACHINE

BACKGROUND OF THE INVENTION

1. Field of the Invention

The present invention relates to a dishwashing machine, and more particularly to an electric control apparatus for controlling the washing or rinsing operation of the dishwashing machine in accordance with the tableware to be cleaned.

2. Description of the Prior Art

There has been proposed a dishwashing machine of the domestic type in which wash water of constant temperature (for instance 60° C.) in a wash tank is sprayed into a washing chamber to wash tableware placed in the washing chamber. When the sprayed wash water is drained outward through the wash tank, wash water of 60° C. newly supplied into the wash tank from a source of hot water is sprayed into the washing chamber to rinse the washed tableware and is returned into the wash tank to be utilized for wash other tableware. In such a dishwashing machine of the commercial type, wash water of constant temperature (for instance 65° C.) is sprayed into a washing chamber to wash tableware placed in the washing chamber. Then, fresh water of high temperature (for instance 85° C.) from a source of hot water is sprayed directly into the washing chamber to rinse the washed tableware. When fresh water flows down into the wash tank, the surplus wash water in the wash tank is drained outward through an overflow pipe arranged in the wash tank, and wash water still remaining in the wash tank is utilized for in place therefor other tableware.

In the dishwashing machines as described above, it should be however recognized that even if the tableware is earthenware, plastic ware or glassware, the temperature of water in washing or rinsing the tableware is maintained in the above-mentioned constant value to cause the following disadvantages.

Firstly, in case temperature of water in rinsing the glassware is high, the speed for drying the rinsed glassware is maintained at a high value. Thus, such composition as magnesium, calcium and iron included within the water for rinsing the glassware coagulates on a surface of the glassware, causing bad finish in rinsing the glassware. Furthermore, when the glassware is repetitively rinsed by water of high temperature, composition on the surface of the glassware is gradually changed to make dull the surface of the glassware.

Secondly, it is noted that high temperature of water in washing or rinsing chilled glassware causes remarkable temperature difference to a surface of the chilled glassware. This results in breakage of the glassware during washing. It is further noted that when ice is put into the glassware warmed during washing and rinsing as described above, the warmed glassware is suddenly cooled causing breakage of the warmed glassware.

Thirdly, in such dishwashing machines as described above, it is to be noted that temperature of water in washing or rinsing is determined in a high value on a basis of earthenware of large heat capacity such as dishes, bowls or the like. Thus, glassware of small heat capacity is remarkably warmed in washing and rinsing, causing occupational diseases such as sodden fingers, burned fingers or the like. In addition, waiting for the cooling of the warmed glassware increases time in being unable to use the glassware. This results in the need for increasing spare glassware.

Fourthly, it is noted that high temperature of water in washing or rinsing plastic ware causes vanishing of gloss or picture on a surface of the plastic ware. This shortens durable time of the plastic ware and exaggerates the difference between new and old plastic ware.

SUMMARY OF THE INVENTION

It is, therefore, a primary object of the present invention to provide an electric control apparatus for the dishwashing machine capable of properly controlling temperature of water in washing or rinsing in accordance with the kinds of tableware to be cleaned.

It is another object of the present invention to provide an electric control apparatus for the dishwashing machine, having the above mentioned characteristics, capable of properly controlling the temperature of water without damage caused by the hot water during washing or rinsing.

It is still another object of the present invention to provide an electric control apparatus for the dishwashing machine, having the above mentioned characteristics, capable of properly controlling temperature of water in washing or rinsing tableware of small heat capacity to thereby enhance the quality in rinsing the tableware of small heat capacity and the efficiency in the use of the rinsed tableware.

It is further an object of the present invention to provide an electric control apparatus for the dishwashing machine, having the above-mentioned characteristics, capable of smoothly controlling temperature of water in washing or rinsing in accordance with the heat capacity of the tableware.

According to the present invention, there is provided an electric control apparatus for a dishwashing machine having a washing chamber, a first electric power operated pumping means for pumping out wash water from a wash water storage tank in the washing chamber, a second electric power operated pumping means for pumping out heated water from a heated water storage tank, and first and second revolving arms arranged within the washing chamber to be supplied with the wash and heated water from the first and second electric power operated pumping means for directing jet streams of the wash and heated water to a rack of tableware placed in the washing chamber respectively.

The electric control apparatus comprises:

mixing means for mixing cold water from a source of cold water into the heated water to form mixing water;

first means for controlling the second electric power operated pumping means such that the second revolving arm directs jet stream of the mixing water from the mixing means to the rack of tableware;

second means responsive to the termination of the control of the first means for controlling the first electric power operated pumping means such that the first revolving arm directs jet stream of the wash water to the rack of tableware; and third means responsive to the termination of the control of the second means for controlling the second electric power operated pumping means such that the second revolving arm directs jet stream of the heated water to the rack of tableware.

In an embodiment of the present invention, there is provided an electric control apparatus for a dishwashing machine having a washing chamber, a first electric power operated pumping means for pumping out wash water from a wash water storage tank in the washing chamber, a second electric power operated pumping means for pumping out heated water from a heated water storage tank, and first and second revolving arms arranged within the washing chamber to be supplied with the wash and heated water from the first and second electric power operated pumping means for directing jet streams of the wash and heated water to a rack of tableware placed in the washing chamber respectively, which comprises:

mixing means for mixing cold water from a source of cold water into the heated water to form mixing water;

first means for controlling the first electric power operated pumping means such that the first revolving arm directs jet stream of the wash water to the rack of tableware;

second means responsive to the termination of the control of the first means for controlling the second electric power operated pumping means such that the second revolving arm directs jet stream of the heated water to the rack of the tableware; and third means responsive to the termination of the control of the second means for controlling the second electric power operated pumping means such that the second revolving arm directs jet stream of the mixing water from the mixing means to the rack of the tableware.

In another embodiment, the present invention is directed to provide an electric control apparatus for a dishwashing machine having a washing chamber, a first electric power operated pumping means for pumping out wash water from a wash water storage tank in the washing chamber, a second electric power operated pumping means for pumping out heated water from a heated water storage tank, and first and second revolving arms arranged within the washing chamber to be supplied with the wash and heated water from the first and second electric power operated pumping means for directing jet streams of the wash and heated water to a rack of tableware placed in the washing chamber respectively, which comprises:

manipulation means for being manipulated in a first manipulating condition when the tableware has large heat capacity and for being manipulated in a second manipulating condition when the tableware has small heat capacity;

mixing means for mixing cold water from a source of cold water into the heated water to form mixing water;

first means responsive to the first manipulating condition of the manipulation means for controlling the first and second electric power operated pumping means in sequence such that the first and second revolving arms direct jet streams of the wash and heated water to the rack of tableware with large heat capacity;

second means responsive to the second manipulating condition of the manipulation means for controlling the second electric power operated pumping means such that the second revolving arm directs jet stream of the mixing water to the rack of tableware with small heat capacity;

third means responsive to the termination of the control of the second means for controlling the first electric power operated pumping means such that the first revolving arm directs jet stream of the wash water to the rack of tableware with small heat capacity; and fourth means responsive to the termination of the control of the third means for controlling the second electric power operated pumping means such that the second revolving arm directs jet stream of the heated water to the rack of tableware with small heat capacity.

BRIEF DESCRIPTION OF THE DRAWINGS

Other objects, features and advantages of the present invention will be readily appreciated from the following detailed description of the preferred embodiments thereof when taken together with the accompanying drawings, in which.

DESCRIPTION OF THE PREFERRED EMBODIMENTS

Figure 1:
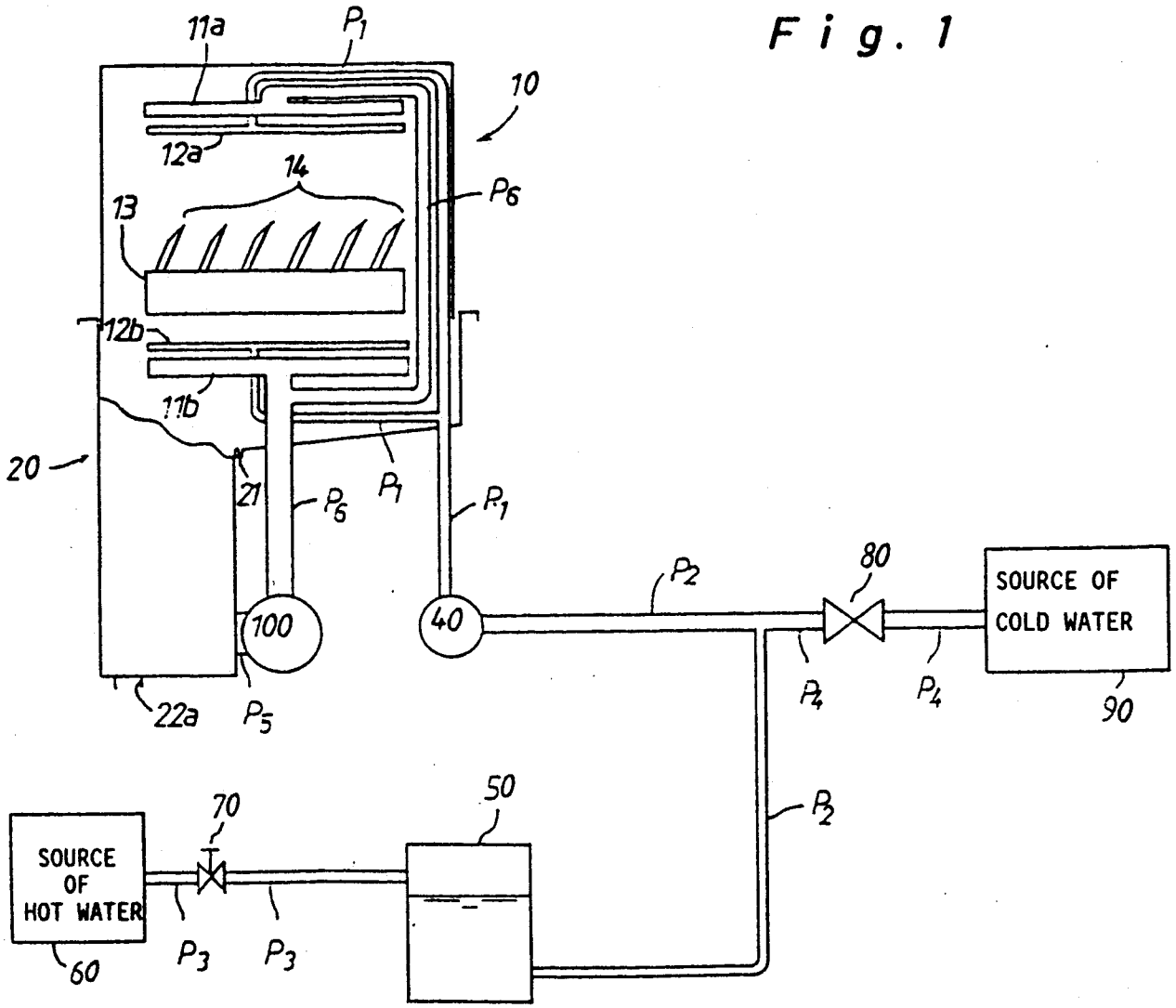
FIG. 1 schematically illustrates a first preferred embodiment of a dish washing machine in accordance with the present invention.

Referring now to the drawings, FIG. 1 schematically illustrates a dishwashing machine of the rack door-type in accordance with a first preferred embodiment of the present invention which includes a box-type housing 10 forming therein a washing chamber, upper and lower revolving wash arms 11*a*, 11*b* and upper and lower rinse arms 12*a*, 12*b* arranged inside the wash arms 11*a*, 11*b*. Disposed between the rinse arms 12*a*, 12*b* is a rack 13 which receives thereon tableware 14 to be washed or rinsed. The wash arms 11*a*, 11*b* are supplied with wash water, as described below, to rotate so as to direct jet streams of the wash water to the rack 13 of tableware. The rinse arms 12*a*, 12*b* are supplied with rinse water, as described below, to rotate so as to direct jet streams of the rinse water to the rack 13 of tableware. The housing 10 has a wash tank 20 which is opened at its opening 21 into the washing chamber through the left bottom portion of the washing chamber.

Figure 2:
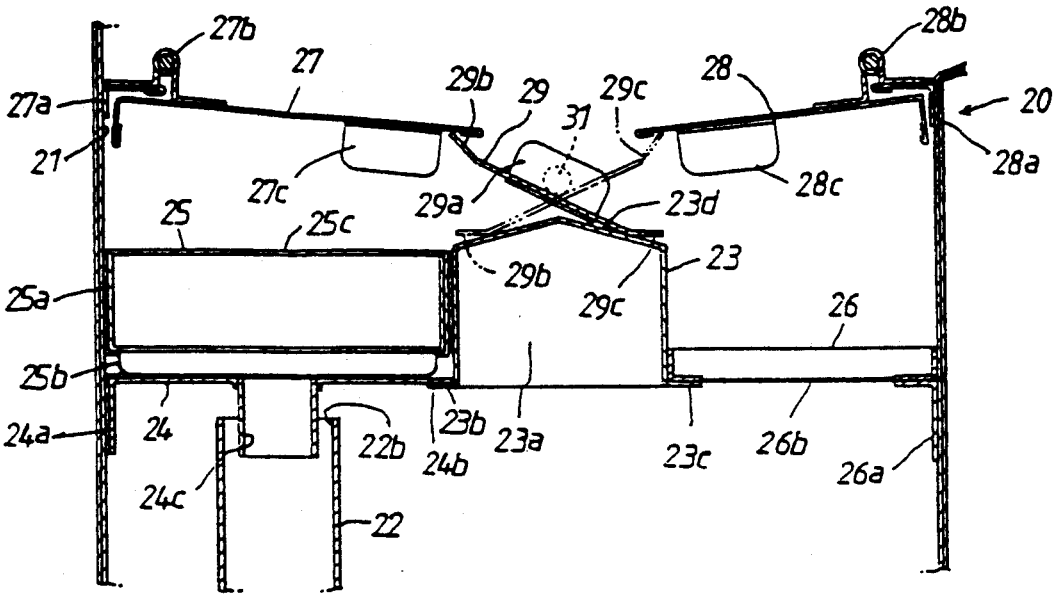
FIG. 2 depicts an enlarge partial cross-section of a wash tank shown in FIG. 1.

As shown in FIGS. 1 and 2, the wash tank 20 is provided therein with an overflow pipe 22 which extends vertically from the left bottom portion of wash tank 20. A lower portion 22*a* of the overflow pipe 22 is opened into the exterior through the left bottom portion of wash tank 20. The wash tank 20 is provided therein with an elongated partition member 23 which has a substantially U-shaped cross-section as shown in FIG. 2 and is horizontally located in the control portion of the opening 21 of the wash tank 20. The partition member 23 has front and rear wall portions 23*a*, 23*a* (only the rear wall portion 23*a* is shown in FIG. 2) which are secured to the front and rear wall portions of the opening 21 of the wash tank 20. A receiving plate 24 is horizontally supported in place within the opening 21 of wash tank 20 above the overflow pipe 22. An L-shaped flange portion 24*a* of the receiving plate 24 is secured to a left wall portion of the opening 21 of wash the tank 20, whereas a right flange portion 24b of the receiving plate 24 is secured on a left flange portion 23b of partition member 23. A drain pipe 24c is downwardly and vertically extended from a central portion of the receiving plate 24 into an upper opening portion 22b of the overflow pipe 22. An outer diameter of the drain pipe 24c is predetermined to be smaller than an inner diameter of the overflow pipe 22.

A box-type strainer 25 is received on the receiving plate 24. The strainer 25 includes a casing 25a and a U-shaped mesh filter 25b. The casing 25a has a U-shaped handle 25c which is secured at its arm portions to central inner portions of left and right walls of casing 25a. An upper opening of the casing 25a is located at a position lower than an upper end of a left wall portion of the partition member 23. The mesh filter 25b is protruded downwardly from a bottom opening of the casing 25a to be received on the plate 24 and to isolate the interior of the casing 25a from the interior of the drain pipe 24c. A strainer 26 has a mesh filter 26b and is horizontally supported in place within the opening 21 of wash tank 20 at the right side of the partition member 23. A left portion of the strainer 26 is secured on a right flange portion 23c of the partition member 23, whereas a right portion of the strainer 26 is secured to a right wall portion of the opening 21 of wash tank 20 by way of an L-shaped bracket 26a. Above the strainer 25, a guide plate 27 is movably hinged at its base portion in an upward or downward direction to a hinge 27b which is secured by way of an L-shaped bracket 27a to the left wall portion of opening 21 of wash the tank 20. The guide plate 27 extends downwards in a slanting manner towards the central portion of the opening 21 of the wash tank 20 and removably screwed at its flange portion 27c to the rear wall of the wash tank 20. In this case, the guide plate 27 is extends over the opening of the strainer 25 and the left end portion of a triangular roof 23d of the partition member 23.

Above the strainer 26, a guide plate 28 is movably hinged at its base portion in an upward or downward direction to a hinge 28b which is secured to the right wall portion of the opening 21 of the wash tank 20 by way of an L-shaped bracket 28a, as shown in FIG. 2. The guide plate 28 extends slantingly downwards toward the central portion of the opening of the wash tank 20 and removably screwed at its flange portion 28c to the rear wall of the wash tank 20. In this case, the guide plate 27 is extended to the opening of the strainer 26 and the right end portion of the roof 23d of the partition member 23. The tip portion of the guide plate 28 is opposite to the tip portion of the guide plate 27.

As shown in FIG. 2, an elongated switchover plate 29 is arranged horizontally above the roof 23d of the partition member 23 under the tip portion of the guide plates 27, 28. The switchover plate 29 has an L-shaped rear flange portion 29a which is supported axially to a rotary shaft 31 of an electromagnetic switchover mechanism 30 (see FIGS. 2, 3), as described later. When the rotary shaft 31 rotates in a counterclockwise direction in FIG. 2, the switchover plate 29 is switched over to a first switchover position defined by a position shown by a two-dotted line in FIG. 2. When the rotary shaft 31 rotates in a clockwise direction, the switchover plate 29 is switched over to a second switchover position defined by a position shown by a solid line in FIG. 2. A left end portion 29b of the switchover plate 29 is slantingly bent up to enable engagement with a lower surface tip portion of the guide plate 27, whereas a right end portion 29c of the switchover plate 29 is slantingly bent up to enable engagement with a lower surface tip portion of the guide plate 28.

The switchover mechanism 30 has a casing 30a which is assembled on an outer surface of the rear wall of the wash tank 20. The rotary shaft 31 of switchover mechanism 30 is rotatably supported at its intermediate portion on the rear wall portion of the wash tank 20 by way of bearings (not shown). One end of the rotary shaft 31 is coupled with the rear flange portion 29a of switchover plate 29, as previously described, whereas the other end of rotary shaft 31 is extended into the casing 30a to support a rotary lever 32. The rotary lever 32 is firmly secured at its central slot portion 32a in a vertical plane to an annular slot portion of the rotary shaft 31. A coil spring 33 is engaged at one of its ends to a hook 33a which is screwed by a bolt 33b to a side wall portion of casing 30a. The coil spring 33 is engaged at another one of its ends with an upper portion 32b of the rotary lever 32 to pull the upper portion 32b in the righthand direction as shown in FIG. 3.

Figure 3:
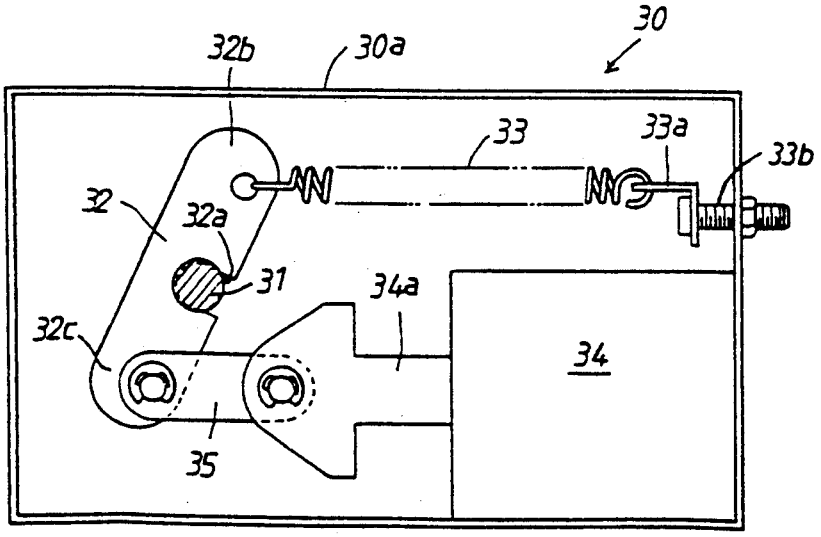
FIG. 3 illustrates the interior of an electromagnetically switchover mechanism.

A linear actuator 34 is arranged under the coil spring 33 within the casing 30a, as shown in FIG. 3. The linear actuator 34 is provided therein with an axially movable rod 34a which is made of iron material and coupled at its tip portion to a lower portion 32c of the rotary lever 32 by way of a link lever 35. When a solenoid of the actuator 34 is deenergized, the rod 34a is maintained in an original position as shown in FIG. 3. When the solenoid of actuator 34 is energized, the rod 34a is attracted against the coil spring 33 to rotate the rotary lever 32 and rotary shaft 31 in the counterclockwise direction in FIG. 3.

A rinse pump 40 is connected between a pipe P1 connected to the rinse arms 12a, 12b and a pipe $P_2$ connected to a storage tank of a gas booster heater 50. The rinse pump 40 is driven by a rinse motor 40a (see FIG. 4) to pump out fresh hot water from the storage tank of a booster heater 50 through the pipe $P_2$ to supply the fresh hot water under pressure into the rinse arms 12a, 12b through the pipe $P_1$. The storage tank of booster heater 50 is supplied with fresh hot water from a source of hot water 60 through a supply valve 70 and a pipe $P_3$. Then, the booster heater 50 acts to heat and maintain the fresh hot water in the storage tank at a predetermined temperature of 65° C. or 85° C. A mixing valve 80 is an electromagnetically operated valve of the normal close type which is disposed within a pipe $P_4$ connected between an intermediate portion of the pipe $P_2$ and a source of cold water 90. Then, the mixing valve 80 is selectively opened to permit supply of cold water from the source of cold water 90 under pressure to a downstream of the pipe $P_2$ through the pipe $P_4$. A wash pump 100 is driven by a wash motor 100a to pump out wash water from the wash tank 20 through a pipe $P_5$ to supply the wash water under pressure to the wash arms 11a, 11b through a pipe $P_6$. In addition, the capacity of the rinse pump 40 is one-tenth as large as the capacity of the wash pump 100.

Figure 4:
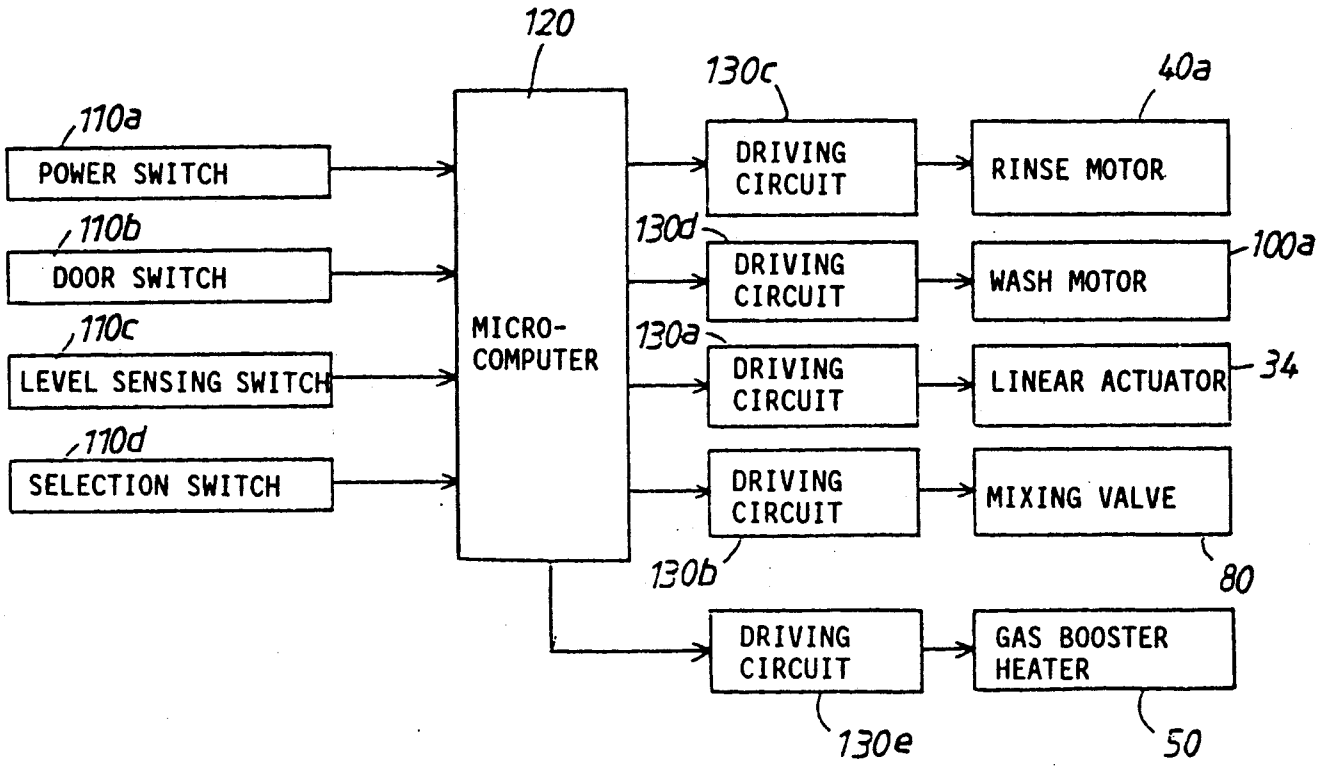
FIG. 4 illustrates a block diagram of an electric control apparatus for the dish washing machine.

As shown in FIG. 4, an electric control apparatus for the dishwashing machine includes a power switch 110a which is manipulated to generate a power supply signal therefrom. A door switch 110b is arranged to be closed by the closure of a door of the washing chamber so as to generate a door signal therefrom. A level sensing switch 110c is arranged to be activated so as to generate a level sensing signal therefrom when the wash tank 20 is filled with the wash water. A selection switch 110d is provided on a proper portion of the door of the washing chamber. The selection switch 110d is closed to generate a selection signal therefrom when the tableware 14 on the rack 13 is glassware or plastic ware, whereas the selection switch 110d is opened to inhibit the generation of the selection signal when the tableware 14 on the rack 18 is earthenware.

Figure 5:
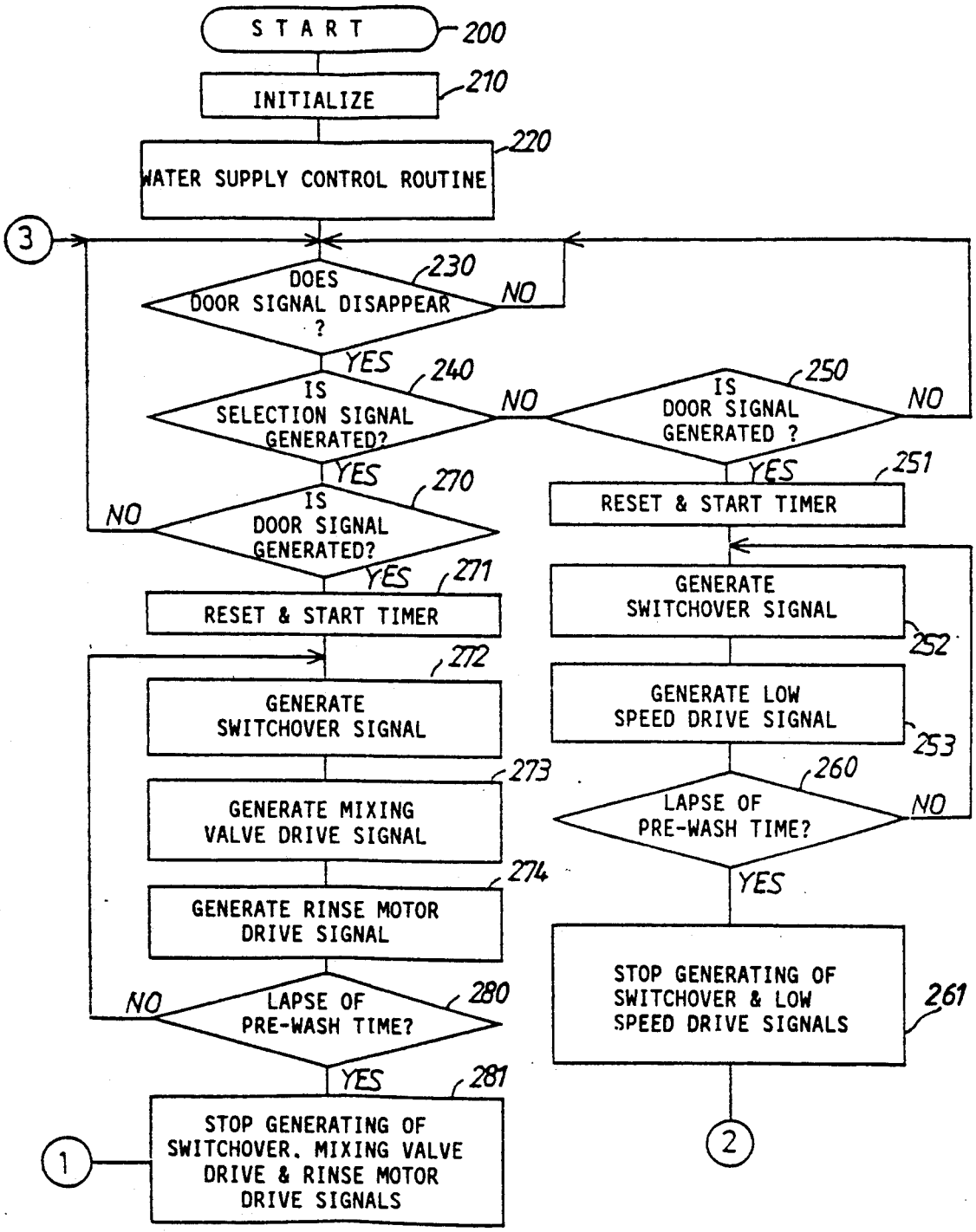
FIGS. 5 to 7 illustrate flow diagrams indicative of operation of a microcomputer shown in FIG. 4.
Figure 6:
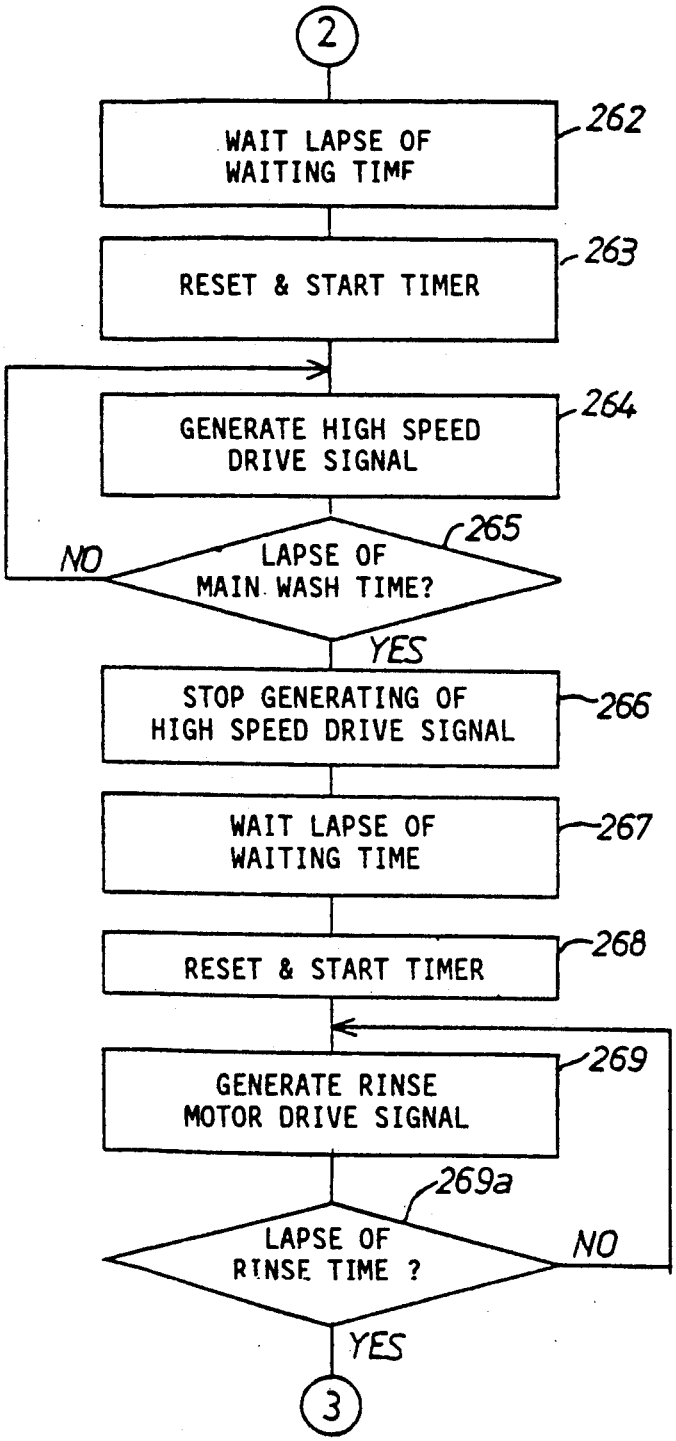
Figure 7:
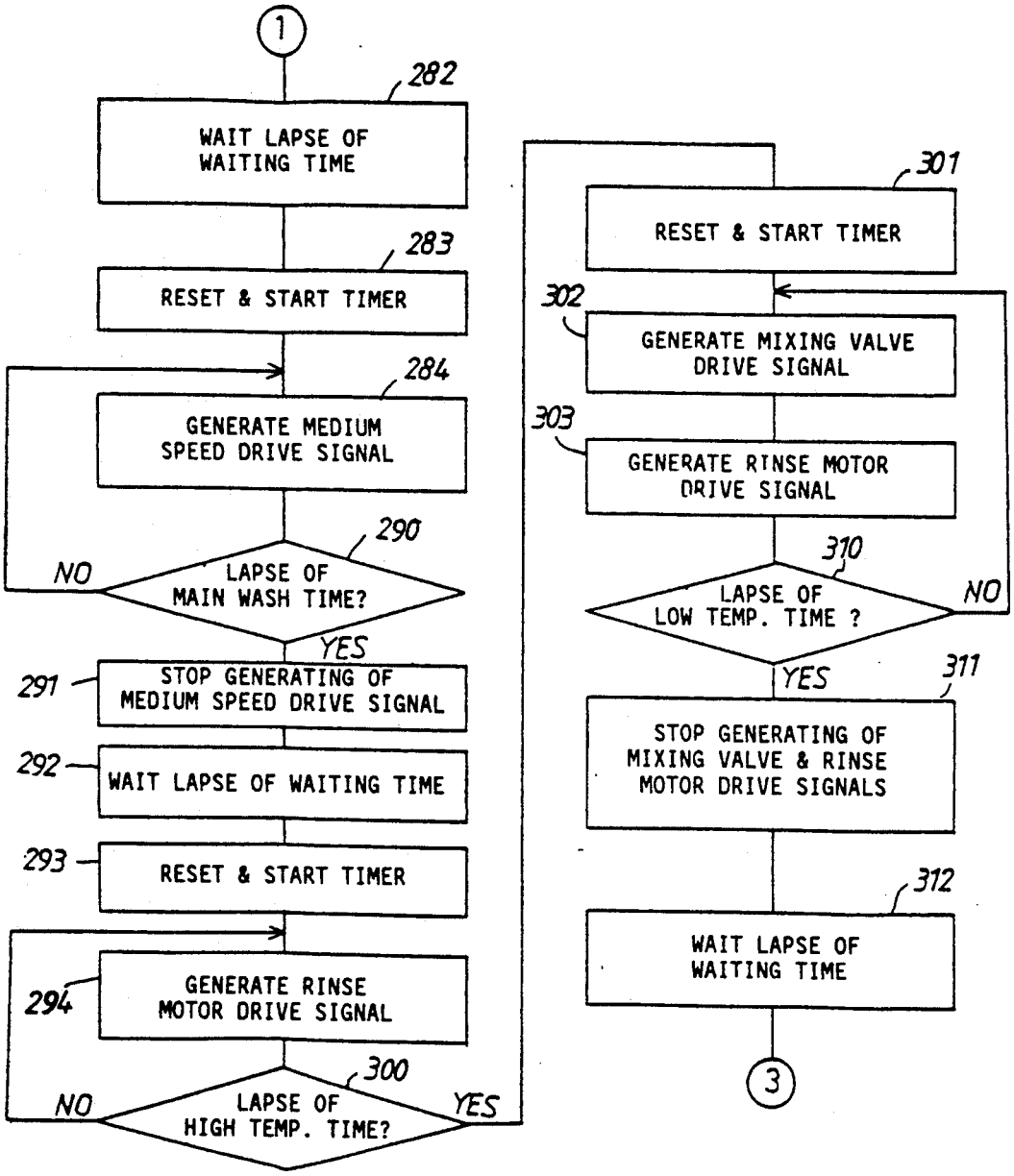

A microcomputer 120 functions with the switches 110b, 110c and 110d to perform a computer program in accordance with a flow diagram as shown in FIGS. 5–7. During operation, the microcomputer 120 executes various operations for controlling driving circuits 130a–130e which are connected to a liner actuator 34, rinse motor 40a, gas booster heater 50, mixing valve 80 and wash motor 100a, respectively. The computer program is previously stored in a read-only-memory or ROM of the microcomputer 120. In addition, the microcomputer 120 starts to execute the computer program in response to the power supply signal from the power switch 110a.

In operation, when the power switch 110a is actuated to generate a power supply signal, the microcomputer 120 starts at a step 200 during execution of the computer program in accordance with the flow diagram of FIG. 5 and is initialized at a step 210 to advance the computer program to a water supply control routine 220. With the control routine 220, the driving circuit 130e is controlled by the microcomputer 120 to drive the booster heater 50 which acts to heat and maintain the fresh water in the storage tank at about 65° C. Then, the driving circuit 130c is controlled by the microcomputer 120 to drive the rinse motor 40a, and the rinse pump 40 is driven by the rinse motor 40a to pump out the hot water of about 65° C. from the storage tank of booster heater 50 through the pipe $P_2$ so as to supply the same hot water into the wash tank 20 through the pipe $P_1$, rinse arms 12a, 12b and the washing chamber. At this stage, it is assumed that the switchover plate 29 is positioned in the state shown by the solid line in FIG. 2.

When the level sensing switch 110c generates a level sensing signal during the supply of the hot water to the wash tank 20, the driving circuit 130c is controlled by the microcomputer 120 to stop the rinse motor 40a which stops the operation of the rinse pump 40. After the rinse pump 40 stops, the driving circuit 130e is again controlled by the microcomputer 120 to drive the gas booster heater 50 which heats and maintains the hot water in the storage tank at about 85° C. Thus, the microcomputer 120 ends execution of the water supply control routioned 220.

Assuming that at this stage the tableware 14 on the rack 13 is earthenware, the selection switch 110d is opened to inhibit generation of any selection signal therefrom. If a door signal disappears from the door switch 110b, the microcomputer 120 detects a "YES" answer at step 230. Then, the microcomputer 120 detects at step 240 a "NO" answer based on the opening of the selection switch 110d to decide a "YES" answer at the following step 250 because of the disappearance of the door signal from the door switch 110b. Thereafter, the microcomputer 120 resets and starts at step 251 a timer which is provided in the microcomputer 120. Thus, the timer starts the measurement of time. This means that the dishwashing machine is conditioned in pre-washing the cycle for the earthenware in the rack 13.

Then, the microcomputer 120 generates at step 252 a switchover signal indicative of the switchover of the switchover plate 29 from the second switchover position to the first switchover position, generates at step 253 a low speed driving signal indicative of low speed of the wash motor 100a, and determines a "NO" answer at the following step 260 in relation to the measuring time of the timer. When the switchover signal appears from the microcomputer 120, as previously described, the liner actuator 34 is energized at its solenoid by the driving circuit 130a to attract the rod 34a so that the rotary lever 32 is rotated against the coil spring 33 to switchover the switchover plate 29 to the first swithover position from the second swithover position.

When the low speed driving signal appears from the microcomputer 120, as previously described, the wash motor 100a is driven by the driving circuit 130d to rotate at a low speed, and the wash pump 100 is driven by the wash motor 100a to rotate at the same low speed. Then, the hot wash water in the wash tank 20 is pumped out by the wash pump 100 through the pipe $P_5$ and supplied into the wash arms 12a, 12b through the pipe $P_6$. Thus, the wash arms 12a, 12b spray powerful jet streams of the wash water supplied thereto toward the rack 13 of the earthenware to remove contaminations, such as food soils and the like, from the earthenware. Thereafter, the wash water flows down toward the opening 21 of wash tank 20 and are guided along the quide plates 27, 28 to further flow down on the switchover plate 29. Subsequently, the wash water is guided along the switchover plate 29 to flow down into the strainer 25. In this instance, even if heavy soils, including large food waste is adhered to the racked earthenware, they flow down into the strainer 25 together with the wash water flowing into the strainer 25, as previously described. Thus, large particles of the heavy soils remain on the filter 25b of the strainer 25, and the remaining soiled wash water drains through the drain pipe 24c and overflow pipe 22 toward the exterior portion of the wash tank 20. When the measuring time of the timer in the microcomputer 120 becomes a predetermined pre-wash time, the microcomputer 120 determines a "YES" answer at step 260. The pre-wash time indicates a minimum time where heavy soils, large food waste or the like are initially removable from the racked earthenware and which is previously stored in the ROM of the microcomputer 120. In addition, the wash water supplied into the washing chamber from the wash tank 20 during the lapse of the pre-wash time is restrained to a little amount. When the determined at step 260 becomes "YES", as previously described, the microcomputer 120 stops at a step 261 resulting in the generation of the switchover and low speed drive signals. Thus, the linear actuator 34 is deenergized at its solenoid by the driving circuit 130a to release the rod 34a from its attracted position, and simultaneously the wash motor 100a is stopped by the driving circuit 130d to stop the wash pump 100. As a result, the rotary lever 32 is rotated clockwise by the coil spring 33 to switchover the switchover plate 29 from the first switchover position to the second switchover position, and simultaneously the initial wash or pre-wash for the earthenware is ended.

After ending the pre-washing cycle for the earthenware as previously described, the microcomputer 120 waits at a step 262 (see FIG. 6) for a lapse of a predetermined waiting time. Upon the lapse of the waiting time, the microcomputer 120 resets and starts again the timer which starts to measure the lapse of time. Then, the microcomputer 120 generates at step 264 a high speed drive signal indicative of a high speed of the wash motor 100*a* to determine a "NO" answer at a step 265 in relation to the measuring time of the timer. Subsequently, the wash motor 100*a* is driven at the high speed by the driving circuit 130*d* in response to the high speed drive signal from the microcomputer 120, and the wash pump 100 is driven by the motor 100*a* at the high speed to pump out the wash water at 65° C. from the wash tank 20 so as to supply the same water into the wash arms 11*a*, 11*b* through the pipe $P_6$. Thus, the wash arms 11*a*, 11*b* spray powerful jet streams of the wash water toward the racked earthenware. This means that the racked earthenware is conditioned in the main washing cycle after the pre-washing cycle described above. During the main washing cycle, the wash water flowing down from the earthenware is guided along the guide plates 27, 28 and further guided along the switchover plate 29 into the strainer 26. In this case, the wash water flowing into the strainer 26 is returned in substantially clean condition into the wash tank 20 through the filter 26*b* of the strainer 26 because the large soils and residue removed from the tableware 14 have remained in the strainer 25, and the heavily soiled wash water has been drained through the overflow pipe 22, as previously described.

When the measuring time of the timer in the microcomputer 120 becomes a predetermined wash time, the microcomputer 120 determines a "YES" answer at step 265. The wash time indicates a time where the earthenware is sufficiently washable and is previously stored in the ROM of the microcomputer 120. When the answer at step 265 becomes "YES", as previously described, the microcomputer 120 stops at step 266 resulting in the generation of the high speed drive signal. Thus, the wash motor 100*a* is stopped by the driving circuit 130*d* to stop the wash pump 100. This means that the main washing cycle for the earthenware after pre-washing cycle is needed.

As understood from the above description, the selection switch 110*d* is maintained in its opening with respect to the racked earthenware, and the pre-wash cycle for the earthenware is started under the first switchover position of the switchover plate 29. During the pre-wash cycle, wash water flowing down from the pre-washed earthenware is guided by the guide plates 27, 28 and switchover plate 29 into the strainer 25. Upon the lapse of the pre-wash time, the switchover plate 29 is switched over to the second switchover position from the first switchover position. Then, the main wash cycle for earthenware after the pre-wash cycle is started, and wash water flowing down from the earthenware is guided by the guide plates 27, 28 and the switchover plate 29 into the strainer 26. Thus, driving the pre-wash cycle, heavy soils and large residue removed from the earthenware remain on the filter 25*b* of the strainer 25, and the soiled wash water is drained through the drain pipe 24*c* and overflow pipe 22. As a result, main wash water flowing down into the strainer 26 during the wash cycle after the pre-wash cycle is returned in substantially cleaned condition into the wash tank 20. This means that for washing glassware or plastic ware after the washing of the earthenware, the wash water returned in the wash tank 20 can be effectively utilized to ensure high quality, efficiency in washing and reduction in the consumption of wash water. Furthermore, all the wash water flowing down from the earthenware during the pre-wash cycle is drained through the overflow pipe 22 out of the wash chamber 20, as previously described. Thus, even if temperature of the wash water flowing down from the pre-washed earthenware is lowered by heat absorption of the earthenware, wash water in the wash tank 20 may be separated from the lowered pre-wash water to maintain it in proper temperature for the following wash cycle.

After waiting the lapse of a predetermined waiting time at step 267, the microcomputer 120 resets and starts the timer at step 268, as previously described, and in turn generates a rinse motor drive signal for the rinse motor 40*a*. Then, the rinse motor 40*a* is driven by the driving circuit 130*c* in response to the rinse motor drive signal from the microcomputer 120 to drive the rinse pump 40 which pumps out the hot water 85° C. as rinse water from the storage tank of the booster heater 50 through the pipe P2 to supply the same water into the rinse arms 12*a*, 12*b* through the pipe $P_1$. Thus, the rinse arms 12*a*, 12*b* spray powerful jet stream of the rinse water toward the racked earthenware. This means that the earthenware is rinsed by the rinse water in high quality owing to the high temperature of the rinse water. When the measuring time of the timer becomes a predetermined rinse time, the microcomputer 120 determines a "YES" answer at step 269*a*. The rinse time indicates a proper time for the rinse of the earthenware and is previously stored in the ROM of the microcomputer 120.

In case the tableware 14 is glassware or plastic ware, the selection switch 110*d* is closed to generate a selection signal therefrom. At this stage, it is assumed that the door switch 110*b* generates a door signal therefrom. Then, the microcomputer 120 determines "YES" answers at steps 240, 270, in sequence, to reset and start the timer at step 271 as previously described. When the microcomputer 120 generates a switchover signal at a step 272, the switchover plate 29 is switched over to the first switchover position, as previously described. When the microcomputer 120 generates at step 273 a mixing valve drive signal for opening of the mixing valve 80, the driving circuit 130*b* acts to open the mixing valve 80. Thus, cold water from the source of cold water 90 is supplied under pressure through the pipe $P_4$ and the mixing valve 80 into the downstream portion of the pipe $P_2$.

When the microcomputer 120 generates a rinse motor drive signal at step 274, the rinse motor 40*a* is driven by the driving circuit 130*c* to drive the rinse pump 40. When the hot water at 85° C. is pumped out by the rinse pump 40 through the upstream portion of the pipe $P_2$ from the storage tank of the gas booster 50, it flows into the downstream portion of the pipe $P_2$ and is mixed with the cold water from the mixing valve 80 to form mixing rinse water at about 40° C. Then, the rinse arms 12*a*, 12*b* are supplied with the mixing rinse water by the rinse pump 40 through the pipe $P_1$ to spray powerful streams of the mixing rinse water toward the racked glassware or plastic ware. This means that the glassware or plastic ware is prewashed, as previously described. In this instance, the jet streams of the mixing water have been maintained at 40° C. at the start of the above-mentioned pre-washing cycle, as previously described. Consequently, the actual temperature of the glassware or plastic ware may not suddenly rise. As a result, the pre-wash of the glassware or plastic ware may be attained without breakage or lowering the quality of the glassware or plastic ware. Other operation and effect are substantially the same as those for the pre-wash of the earthenware.

When the measuring time of the timer becomes another pre-wash time, the microcomputer 120 determines a "YES" answer at step 280 and in turn stops generating at step 281 the switchover signal, the mixing valve drive signal and the rinse motor drive signal. Thus, the switchover plate 29 is switched over to the second switchover position from the first switchover position, the mixing valve 80 is closed, and the rinse motor and pumps 40*a* and 40 are stopped, as previously described.

After the lapse of a waiting time at step 282, the microcomputer 120 resets and starts the timer at a step 283, as previously described. Then, the microcomputer 120 generates at step 284 a medium speed drive signal indicative of a medium speed of the wash motor 100 in response to which the wash motor 100*a* is driven at the medium speed by the driving circuit 130*d* to drive the wash pump 100 at the same speed. Thus, the wash water in the wash pump 20 is pumped out under the medium speed of the wash pump 100 and flows through the pipe $P_6$ under pressure into the wash arms 11*a*, 11*b* to be sprayed toward the racked glassware or plastic ware. This means that the racked glassware or plastic ware is conditioned in the main wash cycle after the pre-wash cycle. In this instance, temperature difference between the temperature of 40° C. of the wash water in the pre-wash cycle and the temperature of 65° C. of the wash water at the main wash cycle is maintained in a smaller value, as previously described, to prevent the glass ware or plastic ware from breaking or lowering in quality. When the measuring time of the timer becomes another wash time, the microcomputer 120 determines a "YES" answer at step 290 and then stops at step 291 generating the medium speed drive signal. Thus, the wash pump 100 is stopped by stopping the wash motor 100*a* in order to finish the wash for the racked glassware or plastic ware. Another wash time as described above indicates a time for washing the glassware or plastic ware and is previously stored in the ROM of the microcomputer 120.

After the lapse of a waiting time at step 292, the microcomputer 120 resets and starts the timer as previously described and in turn generates at step 294 a rinse motor drive signal in response to which the rinse motor 40*a* is driven by the drive circuit 130*c* to drive the rinse pump 40. Then, the rinse pump 40 pumps out fresh water at 85° C. from the storage tank of booster the heater 50 through the pipe $P_2$ to supply the fresh water under pressure to the rinse arms 12*a*, 12*b* as rinse water. Thus, the rinse arms 12*a*, 12*b* spray powerful jet stream of the rinse water toward the racked glassware or plastic ware. This means that the racked glassware or plastic ware is conditioned at a high temperature rinse cycle. In this instance, the temperature difference between the temperature at 65° C. of wash water in the wash cycle and the temperature 85° C. of rinse water in the high temperature rinse cycle is maintained an a smaller value to prevent sudden rise in temperature of the racked glassware or plastic ware. This leads effectively to good sterilization of the glassware or plastic ware and high quality during the rinsing of the same ware.

When the measuring time of the timer becomes a high temperature rinse time, the microcomputer 120 determines a "YES" answer at step 300. The high temperature rinse time indicates a time in which the glassware or plastic ware is durable for heat energy of the rinse water. Then, the microcomputer 120 resets and starts the timer at step 301, as previously described, and in turn generates a mixing valve drive signal and a rinse motor drive signal in sequence at steps 302 and 303. Thus, the mixing valve 80 is opened and the rinse pump 40 is driven, as previously described. As a result, fresh water from the storage tank of the booster heater 50 is mixed with cold water from the source of cold water 90, as previously described, to form mixing rinse water which is sprayed by the rinse arms 12*a*, 12*b* toward the racked glassware or plastic ware. In this instance, temperature of the mixing water may be maintained at about 65° C. because mixing of the fresh hot water with the cold water as described above is permitted after the "YES" determination at step 300. This means that the racked glassware or plastic ware is conditioned at a low temperature rinse cycle without the sudden decrease in temperature after the high temperature rinse cycle.

When the measuring time of the timer becomes a predetermined low temperature rinse time, the microcomputer 120 determines a "YES" answer at step 310. The low temperature rinse time is previously stored in the ROM of the microcomputer 120 and indicates a time necessary for lowering the temperature of the racked glassware or plastic ware in order to make use of the glassware or plastic ware immediately after the final rinse cycle is finished. When the computer program proceeds to step 311, the microcomputer 120 stops generating the mixing valve and rinse motor drive signals. Thus, the mixing valve 80 is closed and the rinse pump 40 is stopped. This signifies the finish of the final rinse cycle for the racked glass ware or plastic ware. In addition, the microcomputer 120 for the lapse of a waiting time at step 312. If the guide plate 27 is lifted with the release of the flange portion 27*c* from the rear wall portion of the wash tank 20, the strainer 25 may be taken out with the handle 25*c* from the wash tank 20 in order to dump the large soils and residue.

As understood from the above description, when the selection switch 110*d* related to the racked earthenware is opened, the earthenware is pre-washed and washed in sequence by wash water at about 65° C. from the wash tank 20 during the pre-wash and main wash cycles and is thereafter rinsed by rinse water at about 85° C. from the gas booster heater 50. In case a selection signal is generated from the selection switch 110*d* with respect to the racked glassware or plastic ware, the glassware or plastic ware is pre-washed by mixing water (about 40° C.) of fresh water (65° C.) from booster heater 50 with cold water from the source of cold water 90 during the pre-wash cycle. Thereafter, the glassware or plastic ware is washed by wash water at about 65° C. from the wash tank 20 during the main wash cycle following the pre-wash cycle. At the of the main wash cycle, the glassware or plastic ware is rinsed by rinse water at about 85° C. from the booster heater 50 during the high temperature rinse cycle and in turn is rinsed by mixing water (about 65° C.) of fresh hot water (85° C.) from the booster heater 50 with cold water from the source of cold water 90 during the low temperature rinse cycle.

This means that the pre-wash, main wash and rinse of the earthenware is automatically attained by water of high temperature suitable for large heat capacity of the earthenware, whereas the pre-wash, main wash and rinse of the glassware or plastic ware are automatically attained by water of steppedly changing temperature suitable for small heat capacity of the glassware or plastic ware. In this instance, temperatures of water in the pre-wash, main wash, high and low temperature rinse cycles for the glassware or plastic ware are automatically controlled at 40° C., 65° C., 85° C. and 65° C., respectively to prevent sudden changes in temperature of the glassware or plastic ware. This protects the glassware from breaking and maintains good quality of the glassware without coagulation of magnesium, calcium, iron or the like on the surface of the glassware caused by hot water during rinsing.

In the operation of the present invention, the selection switch 110d described in the previous embodiment may be eliminated. In this modification, it is necessary to eliminate the step 240 from the flow diagram of FIG. 5 and also to modify the computer program into a new program define by a flow diagram having the steps 200–300, 250–261 and 262–269a of FIGS. 5 and 6. This embodiment is capable of providing an electric control apparatus for tableware with large heat capacity. In the modification, the new program may be replaced with another new program defined by a flow diagram having the steps 200–300, 270–281 and 282–312 of FIGS. 5 and 7. This other embodiment is capable of providing an electric control apparatus for the tableware with small heat capacity.

Figure 8:
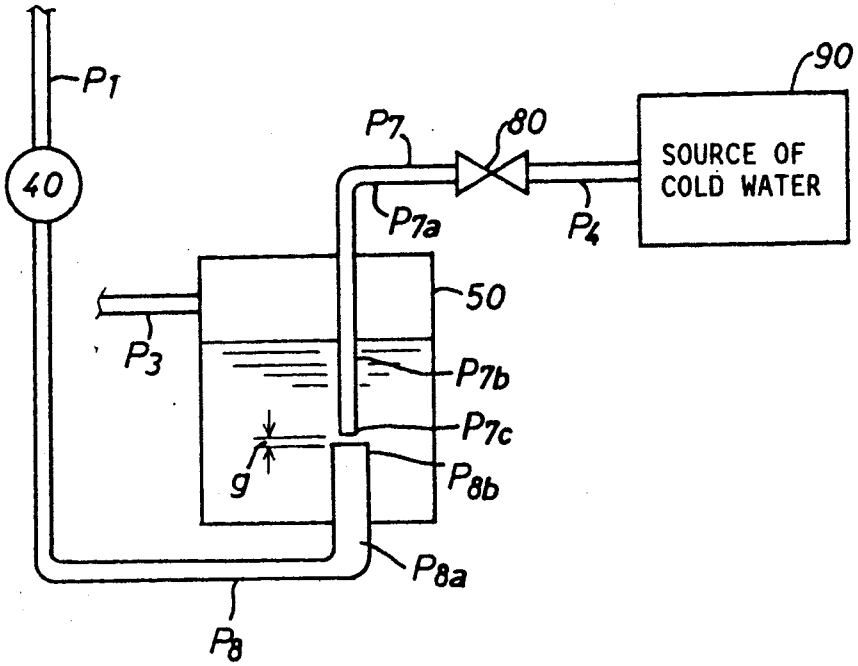
FIG. 8 is a partial view of a second preferrent embodiment in accordance with the present invention.
Figure 9:
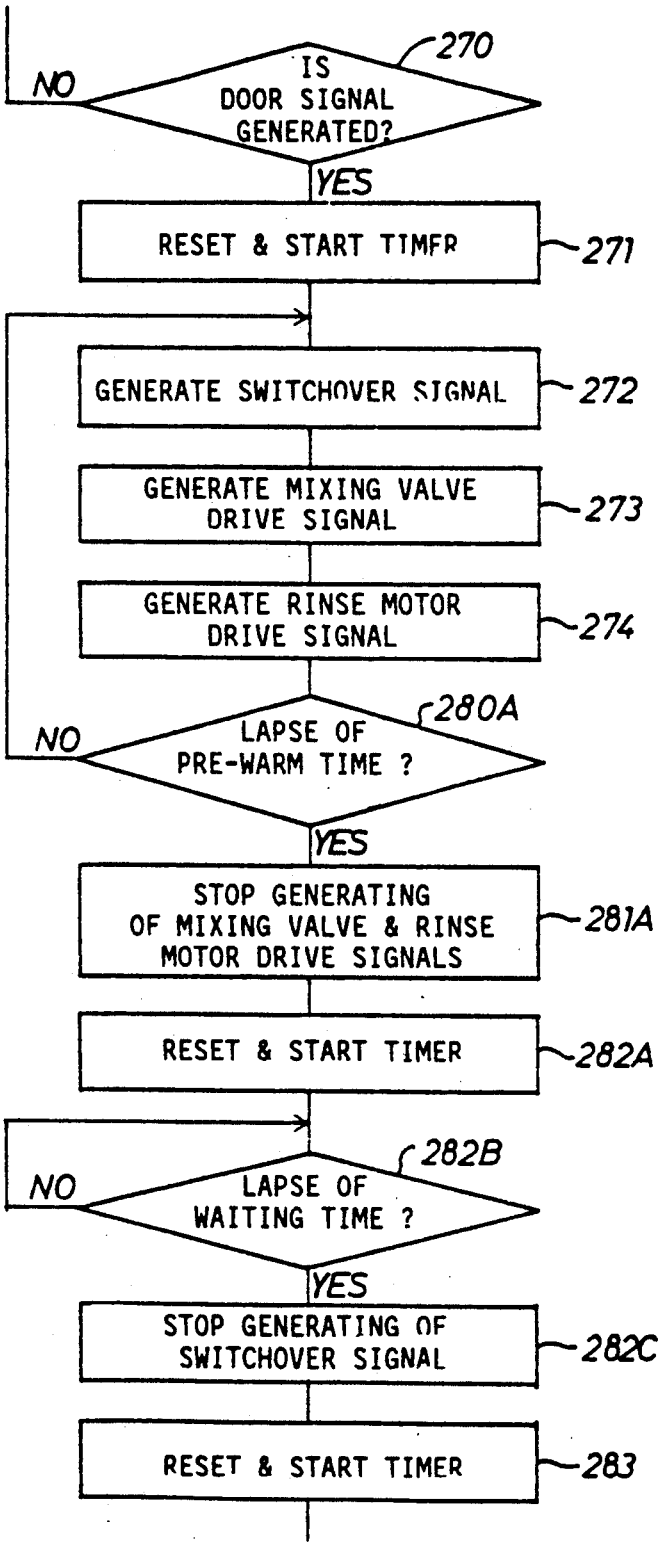
FIG. 9 is a partial flow diagram indicative of operation of the microcomputer in the second embodiment.

FIGS. 8 and 9 illustrate a second preferred embodiment of the present invention in which pipes $P_7$ and $P_8$ replace the pipe $P_2$ and the downstream portion of the pipe $P_4$ as shown in FIG. 1, and in which the flow diagram of FIG. 5 defining a portion of the computer program described in the previous embodiment is partly modified to have a flow diagram as shown in FIG. 9. As shown in FIG. 8, the pipe 7 has an upstream portion $P_{7a}$ which is horizontally extended from the mixing valve 80. The pipe $P_7$ has a downstream portion $P_{7b}$ which is extended vertically downward from the upstream portion $P_{7a}$ into fresh water within the storage tank of the booster heater 50 through an upper wall of the storage tank. The pipe $P_8$ has an upstream portion $P_{8a}$ which is vertically extended into the fresh water within the storage tank of booster heater 50 through a bottom wall of the storage tank. A downstream portion of the pipe $P_8$ is connected to the rinse pump 40. The upstream portion $P_{8a}$ of pipe $P_{8a}$ is arranged to be axially opposite at its opening $P_{8b}$ to an opening $P_{7c}$ of the downstream portion $P_{7b}$ of pipe $P_7$ by way of a predetermined gap g (see FIG. 8). An inner diameter of the upstream portion $P_{8a}$ of pipe $P_8$ is determined to be larger than that of the downstream portion $P_{7b}$ of pipe $P_7$. The gap g is determined in a value which prevents the generation of negative pressure within the opening $P_{7c}$ of pipe $P_7$ during operation of the rinse pump 40 and mixes cold water from pipe $P_7$ with the fresh hot water only within the gap g so as to quickly form mixing water in the same gap g.

In operation, when an answer at step 270 becomes "YES" as previously described in the above embodiment, the microcomputer 120 resets and starts the timer at step 271 and generates a switchover signal, a mixing valve drive signal and a rinse motor drive signal at steps 272 to 274 in sequence. Then, the timer starts measurement of time, the switchover plate 29 is switched over into the first switchover position by the switchover mechanism 30, the mixing valve 80 is opened, and the rinse pump 40 is driven by the rinse motor 40a, as previously described. Thus, cold water flowing out under pressure from the source of cold water 90 is supplied through the upstream portion of pipe $P_4$, mixing valve 80 and pipe $P_7$ into the pretermined gap g to be mixed with fresh hot water within the gap g so as to form mixing water of low temperature at about 40° C. within the same gap g. Then, the mixing water within the gap g is pumped out by the rinse pump 40 through the pipe $P_8$ and is supplied under pressure into the rinse arms 12a, 12b to be sprayed toward the tableware 14. In this instance, cold water flowing out from the opening $P_{7c}$ of pipe $P_7$ is always mixed with only the fresh hot water within the gap g because the gap g is determined, as previously described. This immediately lowers the temperature of the mixing water to be absorbed into the opening $P_{8b}$ of pipe $P_8$. From this reason, it will be understood that even if the tableware 14 is chilled glassware or plastic ware, it may be warmed in a short time by the low temperature of the mixing water sprayed from the rinse arms 12a, 12b prior to the following wash cycle.

When measuring time of the timer becomes a pre-warm time, the microcomputer 120 determines a "YES" answer at step 280A (see FIG. 9) and then stops generating the mixing valve and rinse motor drive signals. Thus, the mixing valve 80 is closed and the rinse pump 40 is stopped. In this embodiment, the pre-warm time has been previously stored in the ROM of the microcomputer 120 and it indicates a time in which tableware with small heat capacity may be maintained at low temperature in advance without breakage or alteration of quality due to temperature rise.

At the end of the execution of step 281A, the microcomputer 120 resets and starts the timer at step 282A to advance the computer program to step 282B. When the measuring time of the timer becomes a waiting time defined at step 282B, the microcomputer 120 determines a "YES" answer and stops generating the switchover signal at step 282C. Thus, the switchover plate 29 is switched over by the switchover mechanism 30 to the second switchover position. The waiting time defined at step 282B has been previously stored in the ROM of the microcomputer 120 and it indicates a time in which after determination of "YES" at step 282B, the entire pre-warmed tableware may be uniformly maintained at low temperature. This means that the entire glassware or plastic ware has been uniformly maintained upon the determination of "YES" at step 282B.

As a result, temperature difference of wash water from the pre-warmed glassware or plastic ware during the main wash cycle (see FIG. 7) is maintained at a small value to substantially attain the same effect as for the main wash cycle for the glass ware or plastic ware in the previous embodiment. Furthermore, it should be noted that switching over of the switchover plate 29 from the first switchover position to the second switchover position is accomplished after the mixing water sprayed into the washing chamber under the pre-warm control has been fully drained by the strainer 25 through the overflow pipe 22. Thus, mixing water under the pre-warm control can be isolated from the wash water in the wash tank 20 to prevent the lowering in temperature of the same wash water and the soiling of it.

When an answer at step 300 (see FIG. 7) becomes "YES" as previously described in the above embodiment, the microcomputer 120 resets and starts the timer at step 301 and in turn generates a mixing valve drive signal and a rinse motor drive signal. At this stage, the switchover plate 29 is maintained in the second switchover position.

When the mixing valve 80 is opened in response to the mixing valve drive signal from the microcomputer 120, cold water flowing out under pressure from the source of cold water 90 is mixed into fresh hot water within the predetermined gap g through the pipes $P_4$, $P_7$ to form mixing water with low temperature at about 65° C. When driven by the rinse motor 40*a* in response to the rinse motor drive signal from the microcomputer 120, the rinse pump 40 pumps out mixing water from the predetermined gap g through the pipe $P_8$ to supply the same water under pressure through the pipe P1 into the rinse arms 12*a*, 12*b*. Then, the rinse arms 12*a*, 12*b* spray jet stream of the mixing water to the tableware 14. In this instance, temperature of the mixing water has been maintained at the proper low value 65° C. at the start of the spraying of the rinse arms 12*a*, 12*b*, as understood from the above description. This enhances quality of the rinse during the low temperature rinse cycle based on repetitive "NO" answers at step 310.

Furthermore, the rinse pump 40 is driven by the rinse motor 40*a* under closure of the mixing valve 80 during execution passing through the steps 269, 269*a* or the steps 294, 300. Then, only the fresh hot water within the booster heater 50 is pumped out by the rinse pump 40 through the gap g and the pipe $P_8$ and supplied through the pipe $P_1$ into the rinse arms 12*a*, 12*b* as hot rinse water. Thus, the rinse arms 12*a*, 12*b* spray jet stream of the hot rinse water toward the tableware 14, thereby effecting the same high temperature rinse cycle as that described in the previous embodiment.

Figure 10:
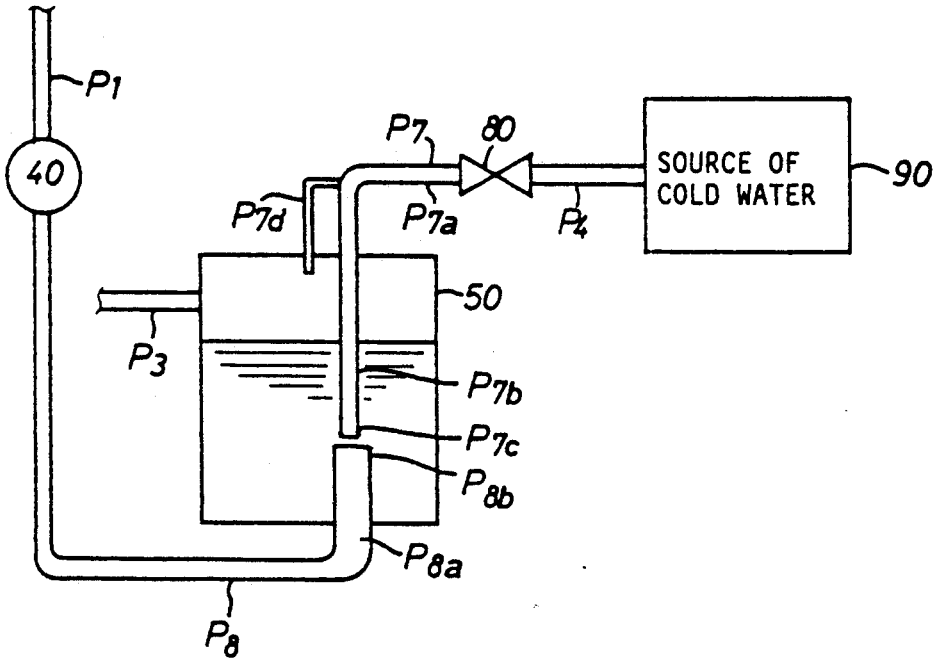
FIG. 10 illustrates a modification of the second embodiment.
Figure 11:
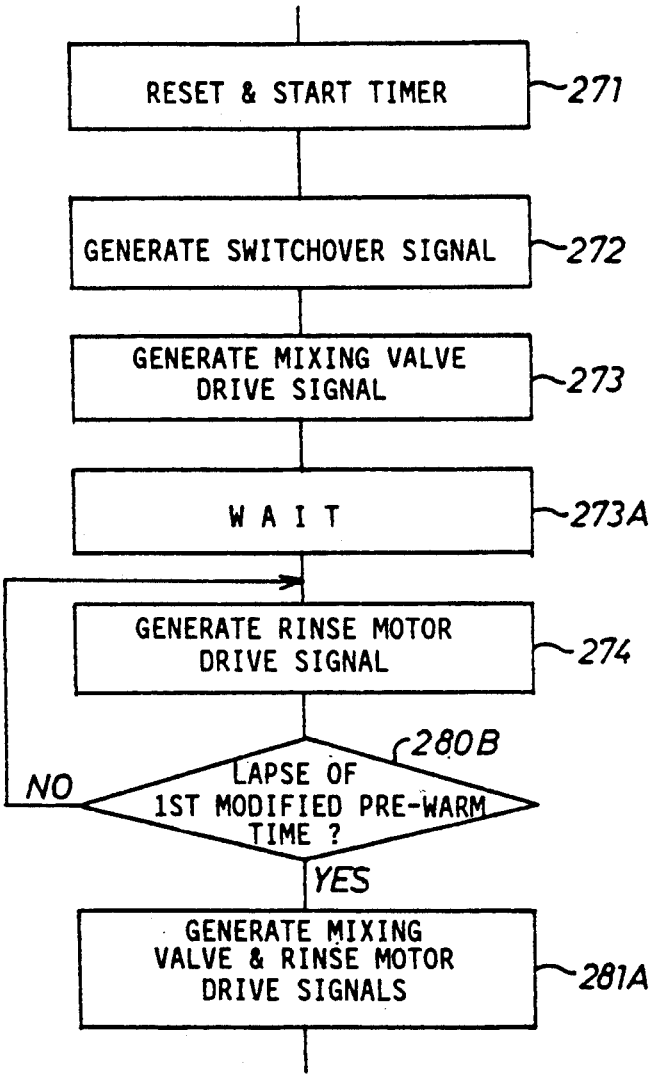
FIG. 11 is a partial flow diagram indicative of operation of the microcomputer in the modification.

In FIGS. 10 and 11, there is illustrated a modification of the second embodiment in which an L-shaped slender tube $P_{7d}$ is adapted in addition to the pipe $P_7$, and in which the flow diagram of FIG. 9 defining the computer program is partly modified into a flow diagram shown in FIG. 11. The slender tube $P_{7d}$ is coupled at its base portion firmly into a small hole portion which is formed on an upper periphery portion of the downstream portion $P_{7b}$ of pipe $P_7$ to face the interior of a tip of the horizontal upstream portion $P_{7a}$. A tip portion of the slender tube $P_{7d}$ is extended vertically down through the upper wall of the storage tank of booster heater 50 into a space within the storage tank. An inner diameter of the tube $P_{7a}$ is considerably smaller than that of the pipe $P_7$.

In operation, when the mixing valve 80 is opened in response to a mixing valve drive signal issued from the microcomputer 120 at step 273 (see FIGS. 9 and 11), as previously described, the microcomputer 120 waits at step 273A a predetermined waiting time which is stored previously in the ROM of the microcomputer 120 to define a time duration in which air and water remain in the pipe $P_7$ before opening of the mixing valve 80 is pushed into the gap g by cold water flowing out pressure from the source of cold water 90 in response to the opening of the mixing valve 80.

When finished waiting at step 273A, the microcomputer 120 generates at step 274 a rinse motor drive signal in response to which the rinse pump 40*a* is driven by the rinse motor 40. In this instance, most of the cold water remaining within the pipe $P_7$ under the closure of the mixing valve 80 flows into the gap g because air in the space within the storage tank of booster heater 50 flows into the upper end of the downstream portion $P_{7b}$ of pipe $P_7$ through the tube $P_{7d}$. In other words, the cold water remaining in the pipe $P_7$ is held only in the portion of the downstream portion $P_{7b}$ immersed in fresh hot water within the storage tank of booster 50. This means that the cold water remaining in the downstream portion $P_{7b}$ may be maintained in a warmed condition by fresh hot water in the storage tank.

When the mixing valve 80 is opened at this stage, as previously described, cold water flowing out under pressure from the source of cold water 90 pushes out air and remaining water from the pipe $P_7$ and flows into the gap g during lapse of the waiting time at step 273A under termination of the rinse pump 40. Upon the lapse of the waiting time at step 273A, the rinse pump 40 is driven to pump out only the mixing water within the gap g through the pipe $P_8$, and the rinse arms 12*a*, 12*b* are supplied with the mixing water from the rinse pump 40 through the pipe $P_1$ to spray it toward the tableware 14.

As described above, since the rinse pump 40 is driven after the air and remaining water within the pipe $P_7$ has been pushed into the gap g, the temperature of the mixing water sprayed from the rinse arms 12*a*, 12*b* is surely maintained at a proper low value of 40° C. at the start in the driving of the rinse pump 40 caused by the execution at step 274. As a result, pre-warm of the tableware 14 may be quickly realized after the start of the driving of the rinse pump 40. In this instance, cold water flowing under pressure through the horizontal upstream portion $P_{7a}$ of pipe $P_7$ coincides with the opening of the base portion of tube $P_{7d}$ to inhibit flow of air from the tube $P_{7d}$ into the pipe $P_7$. This prevents mixing of air into mixing water within the gap g. Furthermore, cold water flowing into the tube $P_{7d}$ from the pipe $P_7$ flows down into the storage tank of booster heater 50. This prevents the waste of cold water and the wetting of circumferes of booster heater 50.

When an answer at step 280B becomes "YES", the microcomputer 120 performs execution passing through step 281A as previously described in the second embodiment. In this case, a first modified pre-warm time indicated at step 280B of FIG. 11 is equal to the sum of the pre-warm time indicated at step 280A of FIG. 9 with the waiting timing indicated at step 273A of FIG. 11 and is previously stored in the ROM of the microcomputer 120.

When the timer is reset and started at step 301 of FIG. 7 as previously described, the microcomputer 120 performs at steps 302, 303 the same execution as that at steps 273, 274 of FIG. 9. Thus, prior to the low temperature rinse cycle for the tableware 14, rinse water of low temperature 65° C. may be formed quickly under the abovementioned mixing of fresh hot water with cold water in the gap g. In addition, the tube $P_{7d}$ may be eliminated to open the small hole portion of the pipe $P_7$ into the atmosphere.

Figure 12:
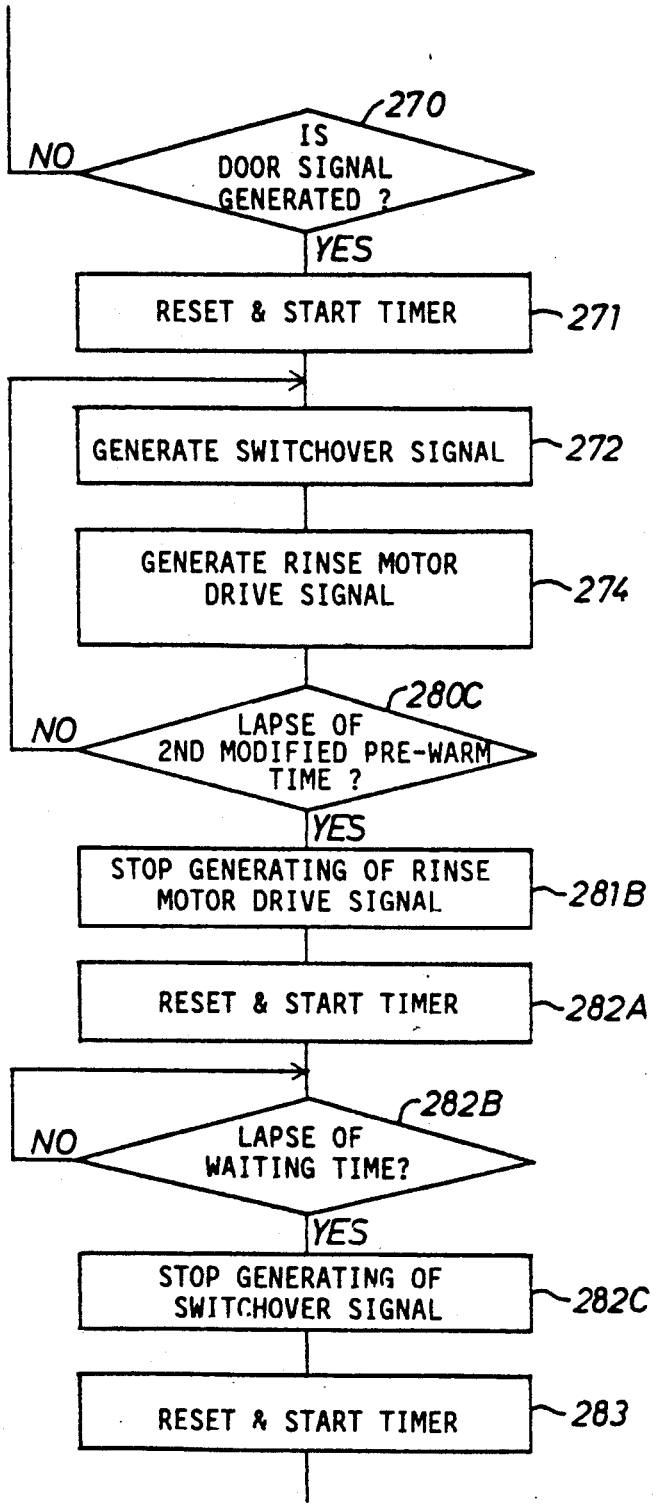
FIG. 12 is a partial flow diagram indicating another modification of the second embodiment.

FIG. 12 illustrates another modification of the second embodiment in which the flow diagram of FIG. 9 defining a portion of the computer program is modified into a flow diagram shown in FIG. 12. When the switchover plate 29 is switched over into the first switchover position in response to a switchover signal issued from the microcomputer 120 at step 272 of FIGS. 9 and 12, as previously described, the microcomputer 120 generates at step 274 of FIG. 12 a rinse motor drive signal in response to which the rinse pump 40 driven by the rinse motor 40*a*. Thus, fresh hot water in the storage tank of booster heater 50 is pumped out by the rinse pump 40 and sprayed by the rinse arms 12*a*, 12*b*, as previously described, to pre-warm the tableware 14. When an answer at step 280C becomes "YES", the microcomputer 120 stops, at step 281B, the generation of the rinse motor drive signal therefrom to perform execution passing through the step 282A. In this instance, a second modified pre-warm time indicated at step 280C is previously stored in the ROM of microcomputer 120 to indicate a time which is predetermined to be shorter than the pre-warm time defined at step 280A of FIG. 9, taking and account the spray of only the fresh water from the booster heater 50.

For the practice of the present invention, the mixing valve 80 is replaced with a pair of mixing valves which may be simultaneously or selectively opened to control temperature of fresh water within the gap g. Furthermore, the pipes $P_7$, $P_8$, as described in the second embodiment, are replaced with a pair of pipes facing each other in an arbitrary direction within the storage tank of booster heater 50.

Having now fully set forth both structure and operation of preferred embodiments of the concept underlying the present invention, various other embodiments as well as certain modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

While the invention has been particularly shown and described in reference to preferred embodiments thereof, it will be understood by those skilled in the art that changes in form and details may be made therein without departing from the spirit and scope of the invention.

What is claimed is:

1. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware placed in said washing chamber respectively, comprising;

mixing means for mixing cold water from a source of cold water into the heated water to form mixing water;

first means for controlling said second electric power operated pumping means such that said second revolving arm directs jet stream of the mixing water from said mixing means to said rack of tableware;

second means responsive to finish in control of said first means for controlling said first electric power operated pumping means such that said first revolving arm directs jet stream of the wash water to said rack of tableware; and third means responsive to finish in control of said second means for controlling said second electric power operated pumping means such that said second revolving arm directs jet stream of the heated water to said rack of tableware.

2. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware placed in said washing chamber respectively, comprising;

mixing means for mixing cold water from a source of cold water into the heated water to form mixing water;

first means for controlling said first electric power operated pumping means such that the first revolving arm directs jet stream of the wash water to said rack of tableware;

second means responsive to finish in control of said first means for controlling said second electric power operated pumping means such that the second revolving arm directs jet stream of the heated water to said rack of tableware; and third means responsive to finish in control of said second means for controlling said second electric power operated pumping means such that said second revolving arm directs jet stream of the mixing water from said mixing means to said rack of tableware.

3. An electric control apparatus as claimed in claim 2, further comprising fourth means for controlling said second electric power operated pumping means such that said second revolving arm directs jet stream of the mixing water from said mixing means to said rack of tableware.

4. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware placed in said washing chamber respectively, comprising;

manipulation means for being manipulated in a first manipulating condition when said tableware has large heat capacity and for being amnipulated in a second manipulating condition when said tableware has small heat capacity;

mixing means for mixing cold water from a source of cold water into the heated water to form mixing water;

first means responsive to the first manipulating condition of said manipulation means for controlling said first and second electric power operated pumping means in sequence such that said first and second revolving arms direct jet streams of the wash and heated water to said rack of tableware with large heat capacity;

second means responsive to the second manipulating condition of said manipulation means for controlling said second electric power operated pumping means such that said second revolving arm directs jet stream of the mixing water to said rack of tableware with small heat capacity;

third means responsive to finish in control of said second means for controlling said first electric power operated pumping means such that said first revolving arm directs jet stream of the wash water to said rack of tableware with small heat capacity; and fourth means responsive to finish in control of the third means for controlling said second electric power operated pumping means such that said second revolving arm directs jet stream of the heated water to said rack of tableware with small heat capacity.

5. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware placed in said washing chamber respectively, comprising;

manipulation means for being manipulated in a first manipulating condition when said tableware has large heat capacity and for being manipulated in a second manipulating condition when said tableware has small heat capacity;

mixing means for mixing cold water from a source of cold water into the heated water to form mixing water;

first means responsive to the first manipulating condition of said manipulation means for controlling said first and second electric power operated pumping means in sequence such that said first and second revolving arms direct jet streams of the wash and heated water to said rack of tableware with large heat capacity;

second means responsive to the second manipulating condition of said manipulation means for controlling said first electric power operated pumping means such that said first revolving arm directs jet stream of the wash water to said rack of tableware with small heat capacity;

third means responsive to finish in control of said secod means for controlling said second electric power operated pumping means such that said second revolving arm directs jet stream of the heated water to said rack of tableware with small heat capacity; and fourth means responsive to finish in control of said third means for controlling said second electric power operated pumping means such that said second revolving arm directs jet stream of the mixing water to said rack of tableware with small heat capacity.

6. An electric control apparatus as claimed in claim 5, further comprising fifth means responsive to the second manipulating condition of said manipulation means for controlling said second electric power operated pumping means prior to control of said second means such that said second revolving arm directs jet stream of the mixing water to said rack of tableware with small heat capacity.

7. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware of small heat capacity placed in said washing chamber respectively, comprising;

first means for controlling said second electric power operated pumping means such that said second revolving arm directs jet stream of the heated water to said rack of tableware of small heat capacity so as to warm it in low temperature;

second means responsive to finish in control of said first means for controlling said first electric power operated pumping means such that said first revolving arm directs jet stream of the wash water to said rack of tableware of small heat capacity; and third means responsive to finish in control of said second means for controlling said second electric power operated pumping means such that said second revolving arm directs jet stream of the heated water to said rack of tableware of small heat capacity.

8. An electric control apparatus as claimed in claim 7, further comprising mixing means for mixing cold water from a source of cold water into the heated water to form mixing water;

wherein said first means is arranged to control said second electric power operated pumping means such that said second revolving arm directs jet stream of the mixing water to said rack of tableware of small heat capacity so as to warm it in the low temperature.

9. An electric control apparatus as claimed in claim 7, further comprising mixing means for mixing cold water from a source of cold water into the heated water to form mixing water;

wherein said second revolving arm is arranged to direct jet stream of the mixing water in the midst of control of said third means.

10. An electric control apparatus for a dishwashing machine having a washing chamber, a first electric power operated pumping means for pumping out wash water from a wash water storage tank in said washing chamber, a second electric power operated pumping means for pumping out heated water from a heated water storage tank, and first and second revolving arms arranged within said washing chamber to be supplied with the wash and heated water from said first and second electric power operated pumping means for directing jet streams of the wash and heated water to a rack of tableware placed in said washing chamber respectively, comprising;

manipulating means for being manipulated in a first manipulating condition when said tableware has large heat capacity and for being manipulated in a second manipulating condition when said tableware has small heat capacity;

first means responsive to the first manipulating condition of said manipulation means for controlling said first and second electric power operated pumping menas in sequence such that said first and second revolving arms direct jet streams of the wash and heated water to said rack of tableware with large heat capacity;

second means responsive to the second manipulating condition of said manipulation means for controlling said second electric power operated pumping means such that said second revolving arm directs jet stream of the heated water to said rack of tableware with small heat capacity so as to warm it in low temperature;

third means responsive to finish in control of said second means for controlling said first electric power operated pumping means such that said first revolving arm directs jet stream of the wash water to said rack of tableware with small heat capacity; and fourth means responsive to finish in control of said third means for controlling said second electric power operated pumping means such that said second revolving arm directs jet stream of the heated water to said rack of tableware with small heat capacity.

11. An electric control apparatus as claimed in claim 10, further comprising mixing means for mixing cold water from a source of cold water into the heated water to form mixing water;

wherein said second revolving arm is arranged to direct jet stream of the mixing water in the midst of control of said fourth means.

12. An electric control apparatus as claimed in claim 1, 2, 4, 5, 9, 8 or 11, wherein said mixing means is arranged to include;

a first pipe connected between said source of cold water and said heated water storage tank and having an opening end portion immersed into the heated water within said heated water storage tank through a peripheral wall thereof;

a second pipe connected between said heated water storage tank and said second revolving arm and having an opening end portion immersed into the heated water within said heated water storage tank through the peripheral wall thereof to face the opening end portion of said first pipe by way of a gap; and an electrically operated mixing valve disposed wherein said first pipe for being selectively opened to permit mixing of cold water from said source of cold water into the heated water within the gap through said first pipe so as to form mixing water within the gap; and wherein said second electric power operated pumping means is arranged to include a pump disposed within said second pipe for selectively pumping the mixing water within the gap through said second pipe into said second revolving arm.

* * * * *